US007530847B2

(12) United States Patent
Siems

(10) Patent No.: US 7,530,847 B2
(45) Date of Patent: May 12, 2009

(54) IMPACT-RESISTANT, HIGH-STRENGTH, BRAIDED WIRING HARNESS

(75) Inventor: W. Peter Siems, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 13 days.

(21) Appl. No.: 11/635,521

(22) Filed: Dec. 8, 2006

(65) Prior Publication Data

US 2008/0135273 A1 Jun. 12, 2008

(51) Int. Cl.
*H01R 9/03* (2006.01)

(52) U.S. Cl. ..... 439/610; 439/932

(58) Field of Classification Search ..... 439/610, 439/98, 99, 932, 449, 451
See application file for complete search history.

(56) References Cited

U.S. PATENT DOCUMENTS

| | | | | |
|---|---|---|---|---|
| 4,629,275 | A | 12/1986 | Maul | |
| 4,804,338 | A | 2/1989 | Dibble et al. | |
| 5,102,351 | A * | 4/1992 | Meshel | 439/607 |
| 5,558,539 | A * | 9/1996 | Lignelet | 439/610 |
| 5,796,045 | A | 8/1998 | Lancien et al. | |
| 6,329,602 | B1 | 12/2001 | Ushiyama et al. | |
| 6,439,929 | B1 | 8/2002 | Jenets | |
| 6,674,005 | B2 | 1/2004 | Yagi et al. | |
| 6,740,808 | B1 | 5/2004 | Chang | |
| 6,765,150 | B2 | 7/2004 | Hsieh | |
| 6,881,904 | B2 | 4/2005 | Millas et al. | |
| 7,247,795 | B2 * | 7/2007 | Sumi et al. | 174/74 R |
| 2003/0062177 | A1 | 4/2003 | Yagi et al. | |
| 2003/0121694 | A1 | 7/2003 | Grogl et al. | |
| 2005/0198820 | A1 * | 9/2005 | Kolberg et al. | 29/868 |
| 2005/0266729 | A1 | 12/2005 | Fukushima et al. | |
| 2006/0176650 | A1 | 8/2006 | Hogan | |

FOREIGN PATENT DOCUMENTS

| | | |
|---|---|---|
| EP | 0 548 530 A1 | 6/1993 |
| EP | 0687037 | 12/1995 |
| GB | 979065 | 1/1965 |
| JP | 2006-164702 | 6/2006 |

OTHER PUBLICATIONS

PCT International Search Report, Ref. No. 06-977; PCT/US2007/023610; Filing Date: Nov. 9, 2007; Caterpillar Inc.

* cited by examiner

*Primary Examiner*—Javaid Nasri
(74) *Attorney, Agent, or Firm*—Finnegan, Henderson, Farabow, Garrett & Dunner

(57) ABSTRACT

A wiring harness is disclosed. The wiring harness may have at least one conducting wire having a length direction, a first end, and an opposing second end. The wiring harness may also have a first electrical device connected to the first end of the at least one conducting wire, and a second electrical device connected to the second end of the at least one conducting wire. The wiring harness may further have a braided covering rigidly connected to the first and second electrical devices. The braided covering may be configured to house the at least one conducting wire and deform in the length direction less than the at least one conducting wire.

19 Claims, 4 Drawing Sheets

IMPACT-RESISTANT, HIGH-STRENGTH, BRAIDED WIRING HARNESS

TECHNICAL FIELD

The present disclosure is directed to a wiring harness and, more particularly, to a wiring harness for use in high-impact and tensile stress applications.

BACKGROUND

Electrical equipment such as engines, construction machines, marine vessels, and robotically controlled devices often operate in hazardous environments. In order to ensure proper and safe operation within these environments, strict regulation on the manufacture of this equipment has been instituted. For example, when operating in a volatile environment filled with combustible fumes, the electrical equipment must be designed to minimize the likelihood of arcing that could ignite the fumes. In fact, the electrical equipment must be designed such that, even if the equipment is impacted or subject to tensile stresses, the likelihood of arcing is still minimized and continued operation of the equipment is ensured. In order to comply with these regulations, equipment manufacturers have concentrated heavily on improving the robustness of wiring harnesses utilized to transmit power and control signals to, from, and within the equipment.

One example of a robust wiring harness designed to improve environmental protection and provide strain relief to soldered joints within the harness is disclosed in U.S. Pat. No. 6,439,929 (the '929 patent) issued to Jenets on Aug. 27, 2002. Specifically, the '929 patent discloses a wiring harness having a backshell for soldered connection of a wire to a mating receptacle of an electronic device. A conductive tubular braided shield is disposed over the wire and one end of the backshell. The braided shield may connect to the backshell in one of two ways. The first way includes extending the tubular braided shield over a rim of the backshell and then holding the braided shield in place on the rim with a clamp. Alternatively, in situations where the rim is omitted from the backshell, a shrink tube may be utilized to hold the braided shield on the end of the backshell. The backshell may provide both impact resistance for the wires contained therein, as well as reduce some of the stress applied to the wires in a tensile situation.

Although the wiring harness of the '929 patent may have improved robustness, it may still be inadequate for some situations. In particular, if only one end of the wiring harness is rigidly connected to a backshell, the braided shield has a taut length greater than that of the wires, or the braided shield is allowed to deform an amount greater than the wires contained therein, excessive strains within the wires may still be possible. In addition, because the shrink tube of the alternative embodiment connects only the braided shield to the backshell, extensive tensile strains may still be induced within the wire. And, because the shrink tube terminates at the end of the backshell, the environmental protection and strain relief provided by the shrink tube may be minimal.

The wiring harness of the present disclosure solves one or more of the problems set forth above.

SUMMARY OF THE INVENTION

One aspect of the present disclosure is directed to a wiring harness. The wiring harness may include at least one conducting wire having a length direction, a first end, and an opposing second end. The wiring harness may also include a first electrical device connected to the first end of the at least one conducting wire, and a second electrical device connected to the second end of the at least one conducting wire. The wiring harness may further include a braided covering rigidly connected to the first and second electrical devices. The braided covering may house the at least one conducting wire and deform in the length direction less than the at least one conducting wire.

Another aspect of the present disclosure is directed to another wiring harness. This wiring harness may include at least one conducting wire, and an electrical device connected to an end of the at least one conducting wire. The wiring harness may also include a heat shrink tube disposed over and connecting the at least one conducting wire to the electrical device. The wiring harness may further include a braided covering housing the wire and being connected to the electrical device by way of the heat shrink tube.

DETAILED DESCRIPTION

Figure 1:
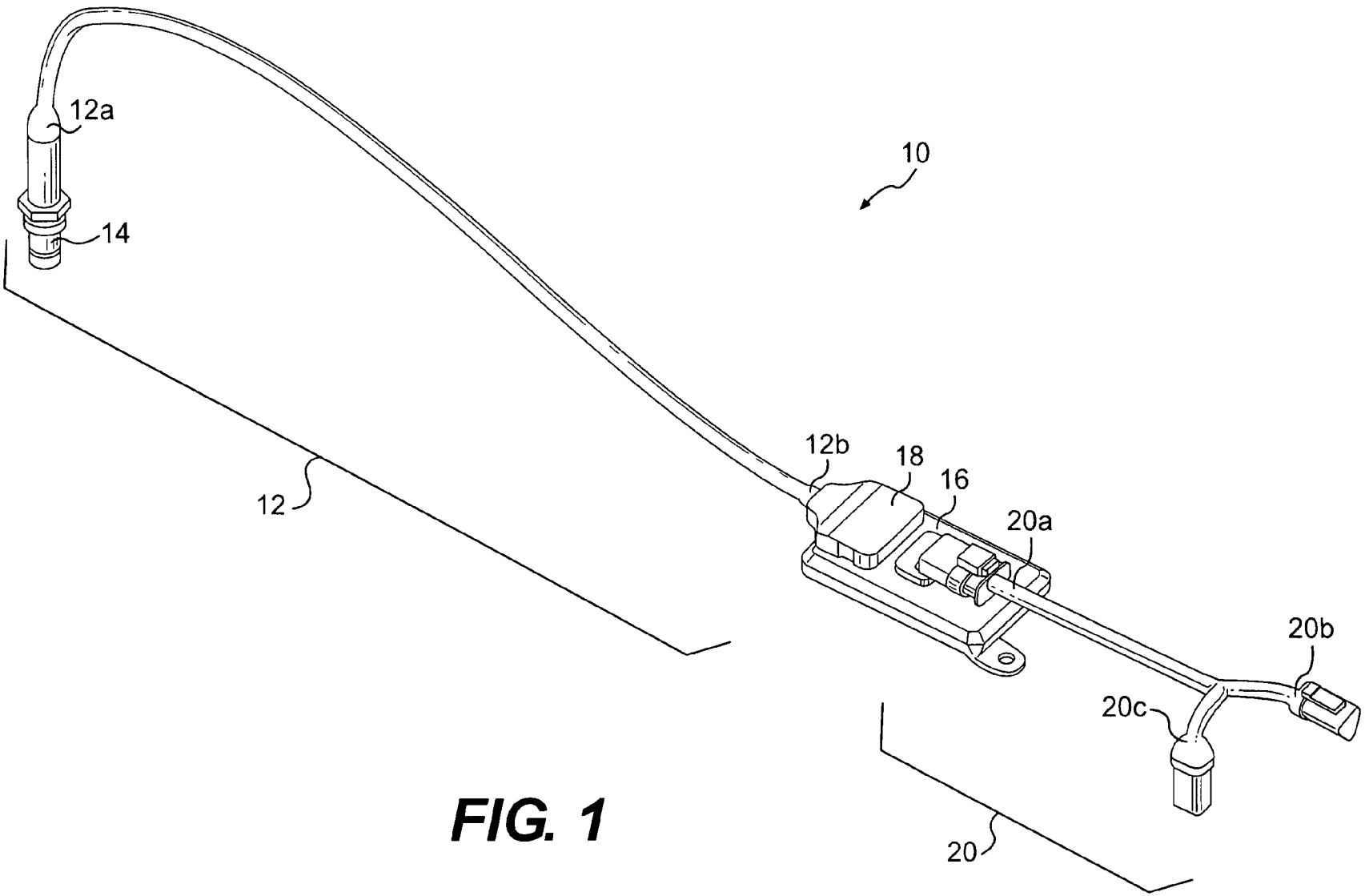
FIG. 1 is a pictorial illustration of an exemplary disclosed wiring harness.

FIG. 1 illustrates an exemplary wiring harness 10 utilized in connection with an exhaust treatment system (not shown) of an internal combustion engine. Specifically, wiring harness 10 may include a main section 12 having a first end 12*a* and a second 12*b*, an exhaust sensor 14 connected to first end 12*a*, and a control module 16 attachable to second end 12*b* by way of a connector 18. Wiring harness 10 may also include a jumper section 20 having a first end 20*a*, a second end 20*b*, and a third end 20*c*. First end 20*a* may join jumper section 20 to control module 16, while second and third ends 20*b*, 20*c* may electrically connect jumper section 20 to components of the internal combustion engine. It should be noted that, although wiring harness 10 is illustrated and described in conjunction with an exhaust system, wiring harness 10 may be just as applicable to any other engine, machine, or tool system requiring the electronic communication of power and/or control signals. As such, it is contemplated that exhaust sensor 14 may be replaced with another electrical device, if desired.

Figure 2:
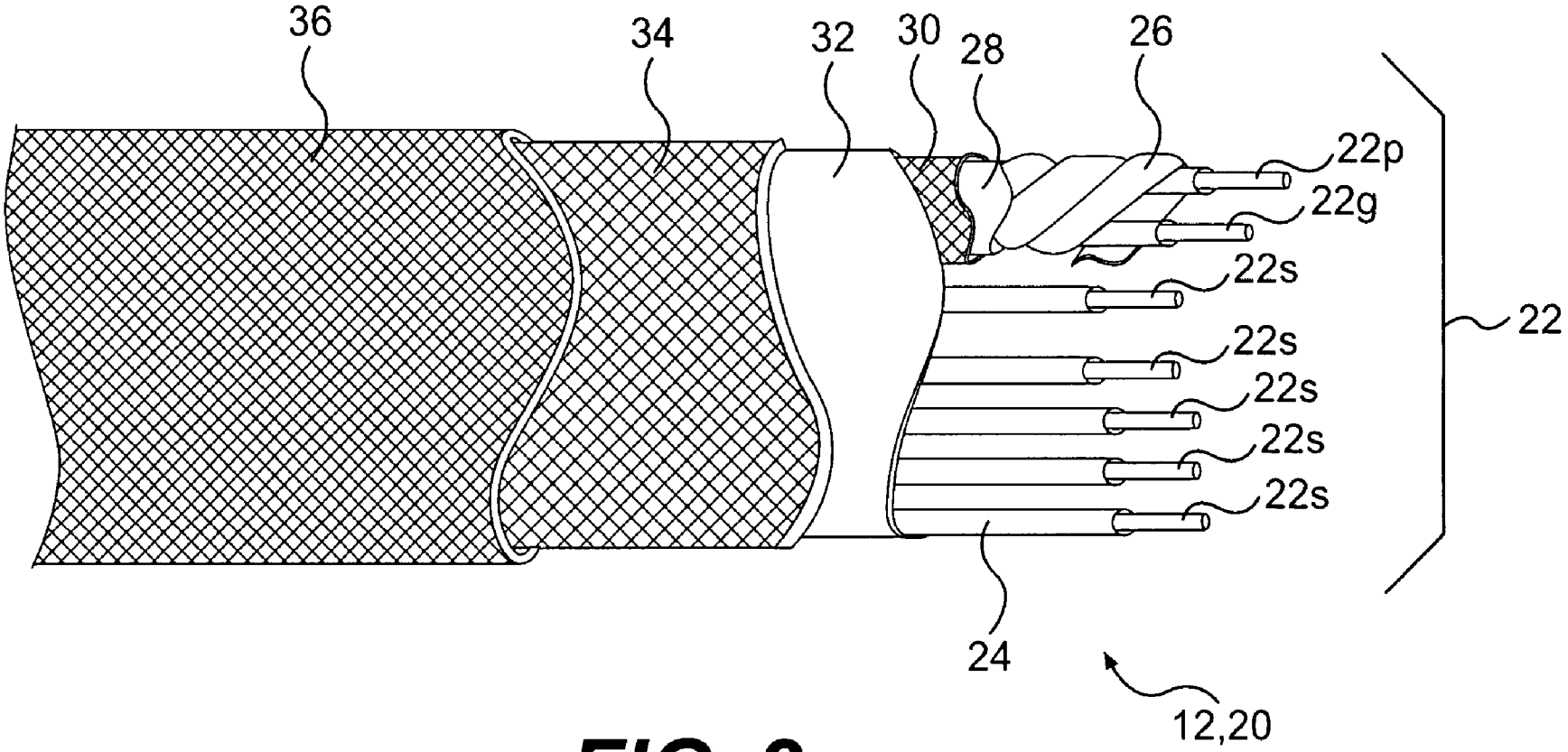
FIG. 2 is a cut-away view illustration of a section of the wiring harness of FIG. 1.

FIG. 2 may be representative of a portion of main and/or jumper sections 12, 20. As seen in this figure, each of main and jumper sections 12, 20 may be a composite assembly of many different components and layers of materials. In particular, each of main and jumper sections 12, 20 may include a plurality of conducting wires 22, each of which may be used for a different purpose. For example, one conducting wire 22*p* may be utilized to conduct power between exhaust sensor 14 and control module 16, or between control module 16 and the components of the internal combustion engine. Another conducting wire 22*g* may function as a ground wire and be electrically communicated with a support frame or other grounding member of the internal combustion engine. Similarly, one or more of conducting wires 22*s* may be utilized to transmit signals through wiring harness 10. Each of conducting wires 22 may be fabricated from a conductive material such as, for example, copper, nickel, aluminum, or another alloy, and be coated with an insulating covering 24. Insulating covering 24 may include, among other things, polyethylene, Teflon®, polyvinylchloride (PVC), polyolefin, or another similar material.

One or more of conducting wires 22 may be maintained separate and/or electrically isolated from the remaining conducting wires 22 by a mechanical barrier. For example, in the embodiment of FIG. 2, power wire 22*p* and ground wire 22*g* may be maintained separate from signal wires 22*s*. That is, power wire 22*p* and ground wire 22*g* may be wrapped together in a foil covering 26. Foil covering 26 may be fabricated from an aluminum, gold, silver, or another alloy to electrically shield power wire 22*p* from interference with signal wires 22*s*, while simultaneously shielding signal wires 22*s* from the influence of power wire 22*p*. In addition to providing electrical shielding, foil covering 26 may also add to the tensile strength of wiring harness 10. It is contemplated that the foil covering may alternatively be replaced with another conductive layer such as, for example, a metal braiding, if desired.

External to foil covering 26, additional layers of material may separate power and ground wires 22*p*, 22*g* from signal wires 22*s* and also function as the mechanical barrier mentioned above. Specifically, a heat shrink tube 28 may surround the external surface of foil covering 26, and a braided covering 30 may be formed around heat shrink tube 28. Heat shrink tube 28 may provide environmental protection against dampness, as well as cushioning against impact and additional tensile strength. Braided covering 30 may provide cushioning, tensile strength, and abrasion resistance. It is contemplated that heat shrink tube 28 may be omitted or only utilized at the ends of main and/or jumper sections 12, 20, if desired.

All of conducting wires 22 may be housed within and protected by common outer layers of material. Specifically, an outer heat shrink tube 32 may contain all of conducting wires 22, while two layers 34, 36 of braided material may contain heat shrink tube 32. The braided material may be a generally tightly woven fabrication of metal and/or polymer such as, for example, nylon, Kynar®, fiberglass, Kevlar®, or another material that provides tensile strength, while affording sufficient porosity to allow draining of moisture from wiring harness 10 and the flexibility required during assembly. For the purposes of this disclosure, the term tightly woven may be used to describe a high braid density, wherein a gap between fibers comprising the braid may be no greater then a diameter of the fibers. When subjected to tensile loads, the braided material may deform (i.e., stretch in a length direction) less than conducting wires 22 under the same load. In addition, the taut length of the braided material may be less than the taut length of conducting wires 22. In this manner, the braided material may absorb any applied tensile stress without undue deformation of conducting wires 22 or strain on associated connecting joints. The heat shrink tubes (inner and outer tubes 28, 32) may both include single or multilayer walls of material that shrink when subject to elevated temperatures. In one example, when the temperature of heat shrink tubes 28, 32 is raised to between 100-120° C., the tubes may shrink to form-fit the wires contained therein. It is contemplated that heat shrink tube 32 may be omitted or only utilized at the ends of main and/or jumper sections 12, 22, if desired. It is further contemplated that only one layer of braided material (i.e., one of layers 34 and 36) may alternatively be utilized in wiring harness 10, if desired. However, it should be noted that, if only one layer of braided material is utilized and/or if heat shrink tube 32 is omitted, the impact resistance and tensile strength of wiring harness 10 may be reduced.

Figure 3A:
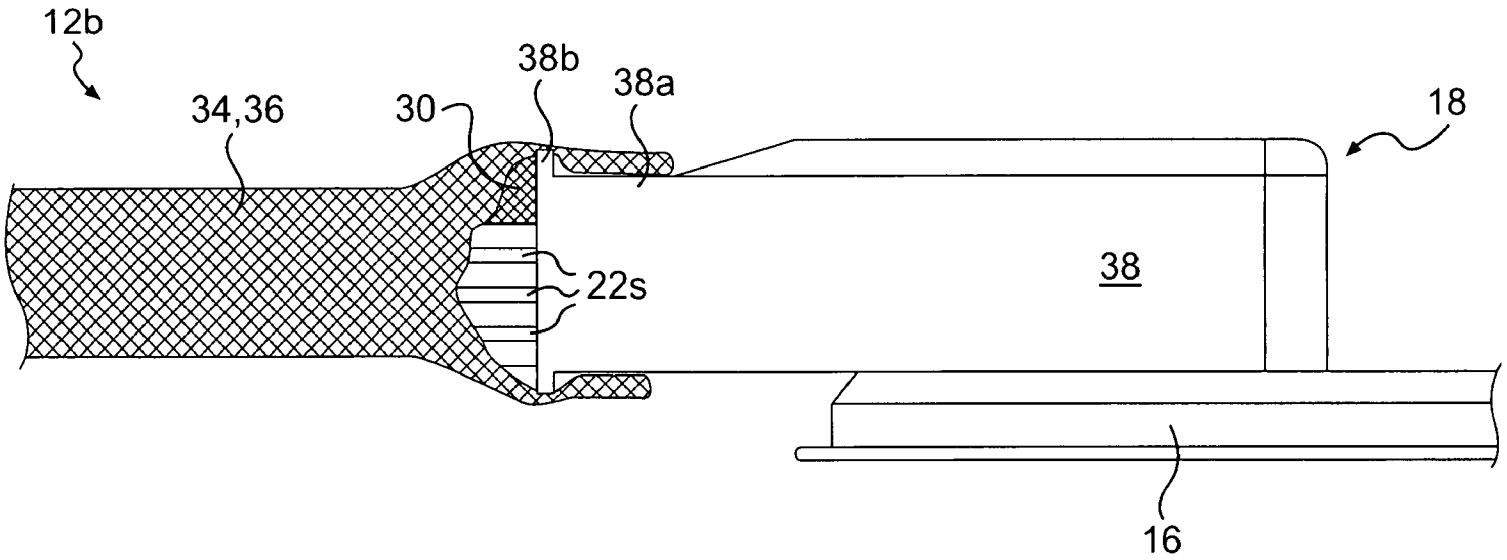
FIG. 3A is a cut-away view illustration of an end section of the wiring harness of FIG. 1.

FIG. 3 is a close up, cut-away view illustration of second end 12*b* of main section 12. As can be seen in this figure, connector 18 may include a backshell 38 having a receiving portion 38*a*. Receiving portion 38*a* may receive conducting wires 22 for connection to control module 16 by way of soldered pin-and-socket connections (not shown). Proximal receiving portion 38*a*, backshell 38 may include an anchor point 38*b*. In this embodiment, first and second layers 34, 36 may one or both extend over anchor point 38*b* and onto receiving portion 38*a*. Because of the weave tightness of first and second layers 34, 36, the braided material thereof may stretch to accommodate anchor point 38*b*, but then mold back to fit a reduced diameter section of receiving portion 38*a*, thereby axially connecting the braided material to backshell 38 and control module 16. It is contemplated that a clamp (not shown) may also be utilized to connect braided layers 34 and 36 to backshell 38, if desired.

Figure 3B:
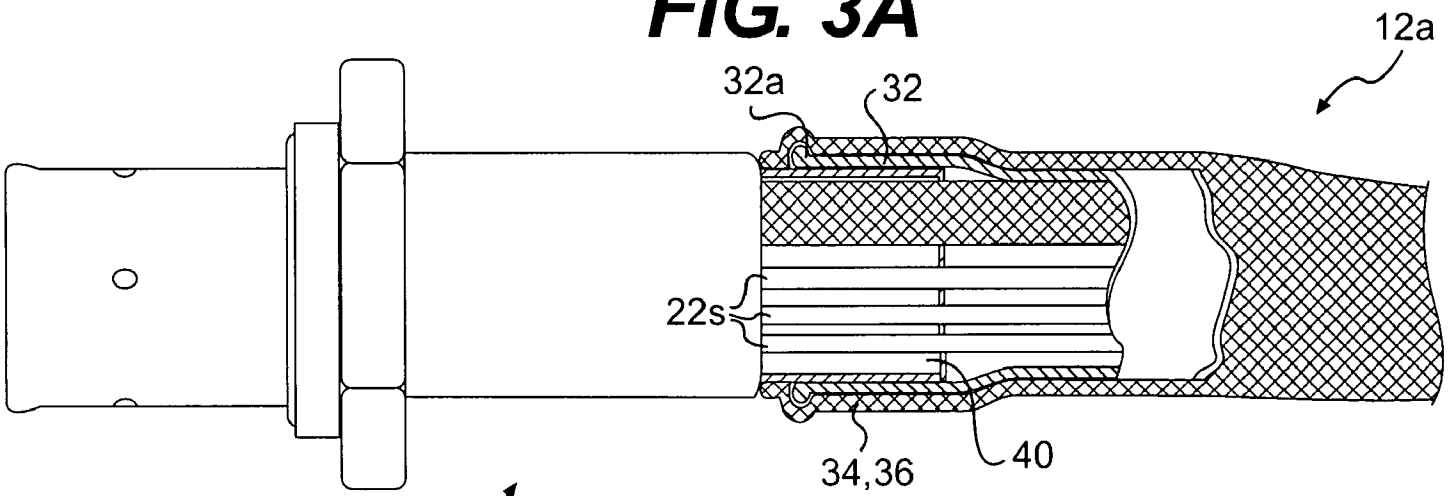
FIG. 3B is another cut-away view illustration of another end section of the wiring harness of FIG. 1.

In situations where an anchor point is unavailable for connection of the braided material to an electrical device, heat shrink tube 32 may be beneficial. For example, as illustrated in FIG. 3B, exhaust sensor 14 may include a receiving portion 40 without an integral anchor point. In this situation, heat shrink tube 32 may be extend from conducting wires 22 over receiving portion 40. Then, as the temperature of heat shrink tube 32 is elevated during assembly, some adhesive from within heat shrink tube 32 may extrude to an end thereof and, when cooled, form an integral anchor point 32*a*. One or both of braided layers 34 and 36 may then be drawn over the newly formed anchor point 32*a* to secure the braided material to exhaust sensor 14. As described above, a clamp may also be utilized to connect the braided material to exhaust sensor 14, if desired. By connecting the opposing ends of both braided layers 34 and 36 to opposing electrical devices (i.e., exhaust sensor 14 and control module 16), any axial extension therebetween may be resisted by the braided material, rather than by conducting wires 22. In addition, if tensile stress was to somehow be generated within conducting wires 22, the shrink tube connection between conducting wires 22 and the two electrical devices may help to transmit this stress to receiving portions 38*a* and 40, rather than through soldered pin-and-socket connections.

Figure 4:
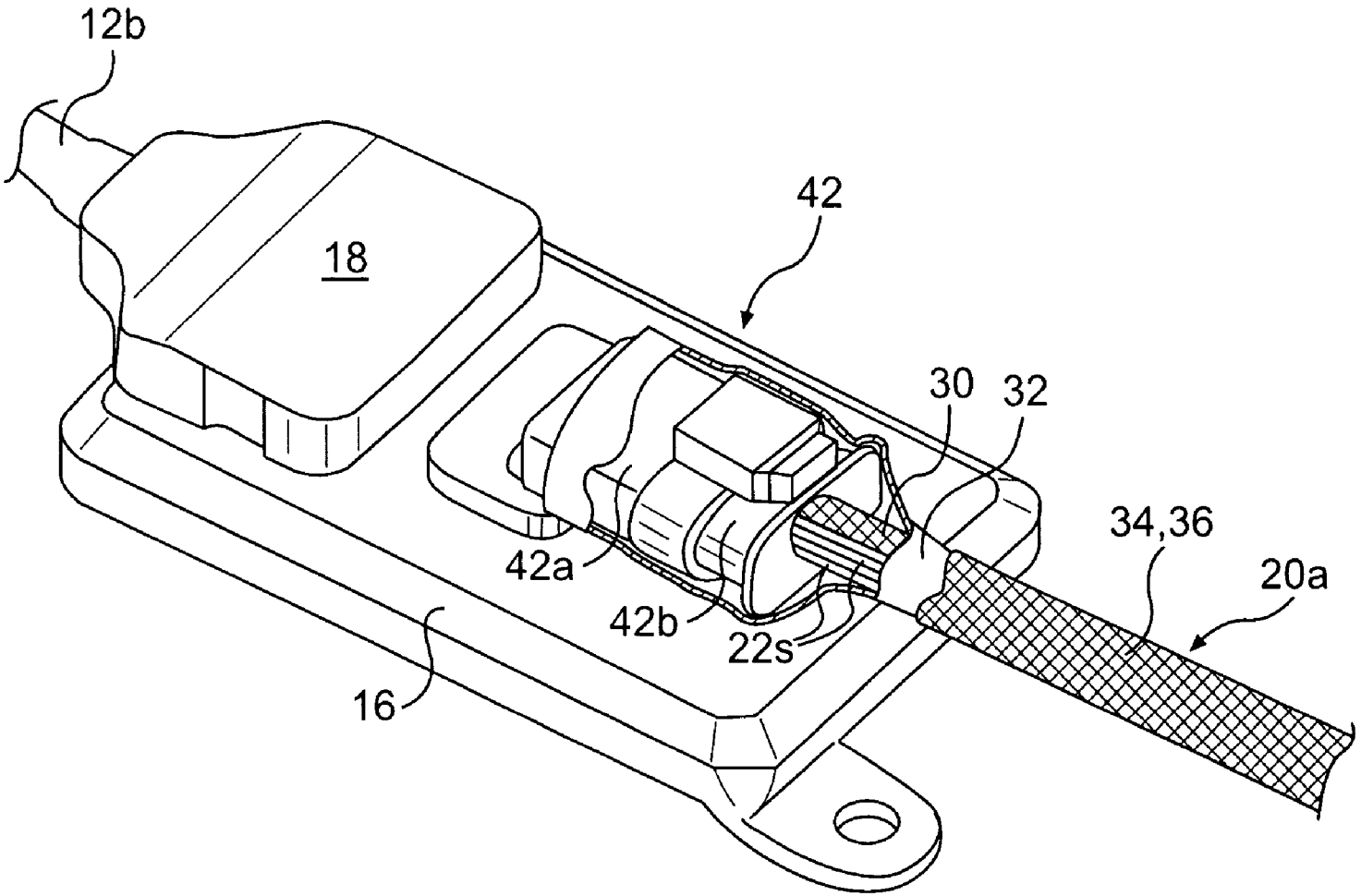
FIG. 4 is a cut-away view illustration of a connection portion of the wiring harness of FIG. 1.

As illustrated in FIG. 4, jumper section 20 may be joined to control module 16 by way of a sealed connector assembly 42. Sealed connector assembly 42 may include two mating components 42*a* and 42*b*. Mating component 42*a* may embody, for example, a female connector having one or more sockets (not shown). In similar manner, mating component 42*b* may embody a male connector having one or more pins for engagement with the sockets of component 42*a*. In order to minimize the likelihood of disconnection between components 42*a* and 42*b*, heat shrink tube 32 may be extended over the connection interface of assembly 42. This extension of heat shrink tube 32, in addition to providing tensile strength to oppose disconnection, may also reduce the likelihood of moisture penetrating the connection interface.

INDUSTRIAL APPLICABILITY

The disclosed wiring harness finds potential application in any electrical system where robustness and durability is desired. The disclosed wiring harness is particularly advantageous for use in a hazardous environment where the likelihood of arcing should be minimized and the harness may be exposed to impact and/or tensile forces.

The disclosed harness may minimize the likelihood of arcing by isolating power lines from any remaining conducting wires. In particular, the power and ground wires 22*p*, 22*g* of wiring harness 10 may be provided with electrical shielding (i.e., foil covering 26) to minimize signal interference. In addition, power and ground wires 22*p*, 22*g* may benefit from cushioning provided by heat shrink tube 28 and braided covering 30, and tensile resistance provided by foil covering 26, heat shrink tube 28, and braided covering 30. This additional protection may minimize the likelihood of damage severe enough to cause arcing.

The disclosed harness may improve impact resistance and tensile strength by providing multiple layers of cushioning material for all wires. Specifically, power wire 22*p* and ground wire 22*g* may both be protected from impact by up to seven different layers of material (24, 26, 28, 30, 32, 34, and 36), each of which also provides tensile strength to wiring harness 10. Similarly, each of signal wires 22*s* may be protected by up to four different layers (24, 32, 34, and 36).

By utilizing the braided material to rigidly join one electrical device (i.e., exhaust sensor 14) to another electrical device (i.e., connector 18), any tensile strain between the two devices may be absorbed by the braided material. Specifically, because the braided material has a taut length less than the taut length of conducting wires 22, the braided material may experience strain before the conducting wires are affected. And, even if the strain is significant enough that conducting wires 22 are stressed, the braided material may absorb a greater amount of the stress due to its more ridged characteristics (i.e., the braided material stretches less than conducting wires 22 under the same applied force).

Finally, even if some stress is induced within conducting wires 22, the stress may be diverted away from any associated soldered joints. That is, because conducting wires 22 may be joined to receiving portions 38*a*, 40 by way of heat shrink tube 32, any stresses induced within conducting wires 22 may be transmitted to receiving portions 38*a* and 40 rather than the soldered joints within the corresponding electrical devices.

Additional tensile strength may be provided by extending heat shrink tube 32 over the connection interface of assembly 42. Specifically, the likelihood of disconnection occurring between mating connectors 42*a* and 42*b* may be minimized by the presence of heat shrink tube 32 and the cohesion it affords.

It will be apparent to those skilled in the art that various modifications and variations can be made to the wiring harness of the present disclosure. Other embodiments of the wiring harness will be apparent to those skilled in the art from consideration of the specification and practice of the wiring harness disclosed herein. It is intended that the specification and examples be considered as exemplary only, with a true scope being indicated by the following claims and their equivalents.

What is claimed is:

1. A wiring harness, comprising:

at least one conducting wire having a length direction, a first end, and an opposing second end;

a first electrical device connected to the first end of the at least one conducting wire;

a second electrical device connected to the second end of the at least one conducting wire;

a braided covering rigidly connected to the first and second electrical devices, the braided covering configured to house the at least one conducting wire and deform in the length direction less than the at least one conducting wire; and the at least one conducting wire having a taut length greater than a taut length of the braided covering.

2. The wiring harness of claim 1, wherein the first electrical device includes a backshell having an anchor point over which the braided harness extends.

3. The wiring harness of claim 2, wherein the anchor point is integral with the backshell.

4. The wiring harness of claim 2, wherein the anchor point is formed when a heat shrink tube is applied to the backshell.

5. The wiring harness of claim 1, further including a heat shrink tube connecting the at least one conducting wire to the first electrical device, wherein the braided covering is disposed external to the heat shrink tube.

6. The wiring harness of claim 5, wherein:

the first electrical device includes a first connector and a mating second connector; and the shrink tube extends from the at least one conducting wire over an interface between the first and second connectors.

7. The wiring harness of claim 1, wherein the braided covering includes a first layer of braiding and a second layer of braiding disposed external to the first layer of braiding.

8. The wiring harness of claim 1, wherein the at least one conducting wire includes a plurality of conducting wires.

9. The wiring harness of claim 8, wherein:

the plurality of conducting wires includes a power wire, a ground wire, and at least one other conducting wire; and the plurality of conducting wires are shielded from the at least one other conducting wire.

10. The wiring harness of claim 9, further including a foil winding disposed about the power and ground wires.

11. The wiring harness of claim 9, further including a second braided covering separating the power wire and the ground wire from the at least one other conducting wire.

12. A wiring harness, comprising:

at least one conducting wire;

an electrical device connected to an end of the at least one conducting wire;

a heat shrink tube disposed over the at least one conducting wire and the electrical device, the heat shrink tube connecting the at least one conducting wire to the electrical device; and a braided covering housing the wire and being connected to the electrical device by way of the heat shrink tube.

13. The wiring harness of claim 12, wherein the heat shrink tube forms an anchor point for the braided covering.

14. The wiring harness of claim 12, wherein:

the electrical device includes a first connector and a mating second connector; and the shrink tube extends from the at least one conducting wire over an interface between the first and second connectors.

15. The wiring harness of claim 12, wherein the braided covering includes a first layer of braiding and a second layer of braiding disposed external to the first layer of braiding.

16. The wiring harness of claim 12, wherein the at least one conducting wire includes a plurality of conducting wires.

17. The wiring harness of claim 16, wherein:

the plurality of conducting wires includes a power wire, a ground wire, and at least one other conducting wire; and the plurality of conducting wires are shielded from the at least one other conducting wire.

18. The wiring harness of claim 17, further including a foil winding disposed about the power and ground wires.

19. The wiring harness of claim 17, further including a second braided covering separating the power wire and the ground wire from the at least one other conducting wire.

* * * * *